US007482520B2

(12) United States Patent
Payerl

(10) Patent No.: US 7,482,520 B2
(45) Date of Patent: Jan. 27, 2009

(54) MUSICAL RHYTHM INSTRUMENT

(75) Inventor: Wolfgang Payerl, Munchsteinach (DE)

(73) Assignee: Roland Meinl Musikinstrumente GmbH & Co. KG, Neustadt (DE)

( * ) Notice: Subject to any disclaimer, the term of this patent is extended or adjusted under 35 U.S.C. 154(b) by 0 days.

(21) Appl. No.: 11/581,752

(22) Filed: Oct. 17, 2006

(65) Prior Publication Data

US 2008/0087158 A1 Apr. 17, 2008

(51) Int. Cl.
*G10D 13/08* (2006.01)

(52) U.S. Cl. ..... 84/402

(58) Field of Classification Search ..... 84/418, 84/402–410

See application file for complete search history.

(56) References Cited

U.S. PATENT DOCUMENTS

| | | | | |
|---|---|---|---|---|
| 1,613,978 | A * | 1/1927 | Berton | 84/402 |
| 2,785,596 | A * | 3/1957 | Korosh | 84/422.1 |
| 3,994,197 | A * | 11/1976 | Bills | 84/418 |
| 2005/0028667 | A1 * | 2/2005 | Navarro | 84/418 |

* cited by examiner

*Primary Examiner*—Kimberly R Lockett
(74) *Attorney, Agent, or Firm*—Browdy and Neimark, P.L.L.C.

(57) ABSTRACT

The invention relates to a musical rhythm instrument comprising sounding bodies, especially in the form of jingles or the like, and a holding device for said sounding bodies, wherein said holding device is designed to be fastened to the user's foot.

19 Claims, 2 Drawing Sheets

MUSICAL RHYTHM INSTRUMENT

BACKGROUND OF THE INVENTION

1. Field of the Invention

The invention relates to a musical rhythm instrument comprising sounding bodies, especially in the form of jingles or the like, and a holding device for said sounding bodies.

2. Background Art

Musical instruments of this type are known, for example, in the form of a tambourine, which is operated or struck, respectively, with the hand.

Also known are rhythm instruments that can be operated, such as a cymbal for example, with the foot, wherein the foot, as a rule, operates a kind of pedal and this movement is then converted into the pivot movement of a stick.

SUMMARY OF THE INVENTION

With this as the starting point, the invention is based on the object of creating a musical instrument provided with sounding bodies, such as jingles, which can be operated directly with the foot, and which accordingly enables the player to play one or multiple additional instruments with the hand.

This object is met according to the invention in such a way that the holding device is designed for fastening to the user's foot.

In this respect, provision may be made in particular for the holding device to hook at least partly around the user's foot on top and/or at the bottom and to preferably also hook around it at least partly on the sides.

To provide for a precise fastening, securing means, such as Velcro fasteners, straps or buckles may be provided as well.

Provision is advantageously made for bolt projections to extend away from the top of the holding device, said bolt projections having jingle-like sounding bodies disposed on them with vertical movement, the tops of the bolts being provided with end stops.

The sounding bodies may be arranged on a support plate, which, in turn, is fixed to the top of the holding device, especially screwed to the same.

The invention will be explained in more detail below based on a preferred embodiment, in conjunction with the drawing.

DESCRIPTION OF THE PREFERRED EMBODIMENT

Figure 1:
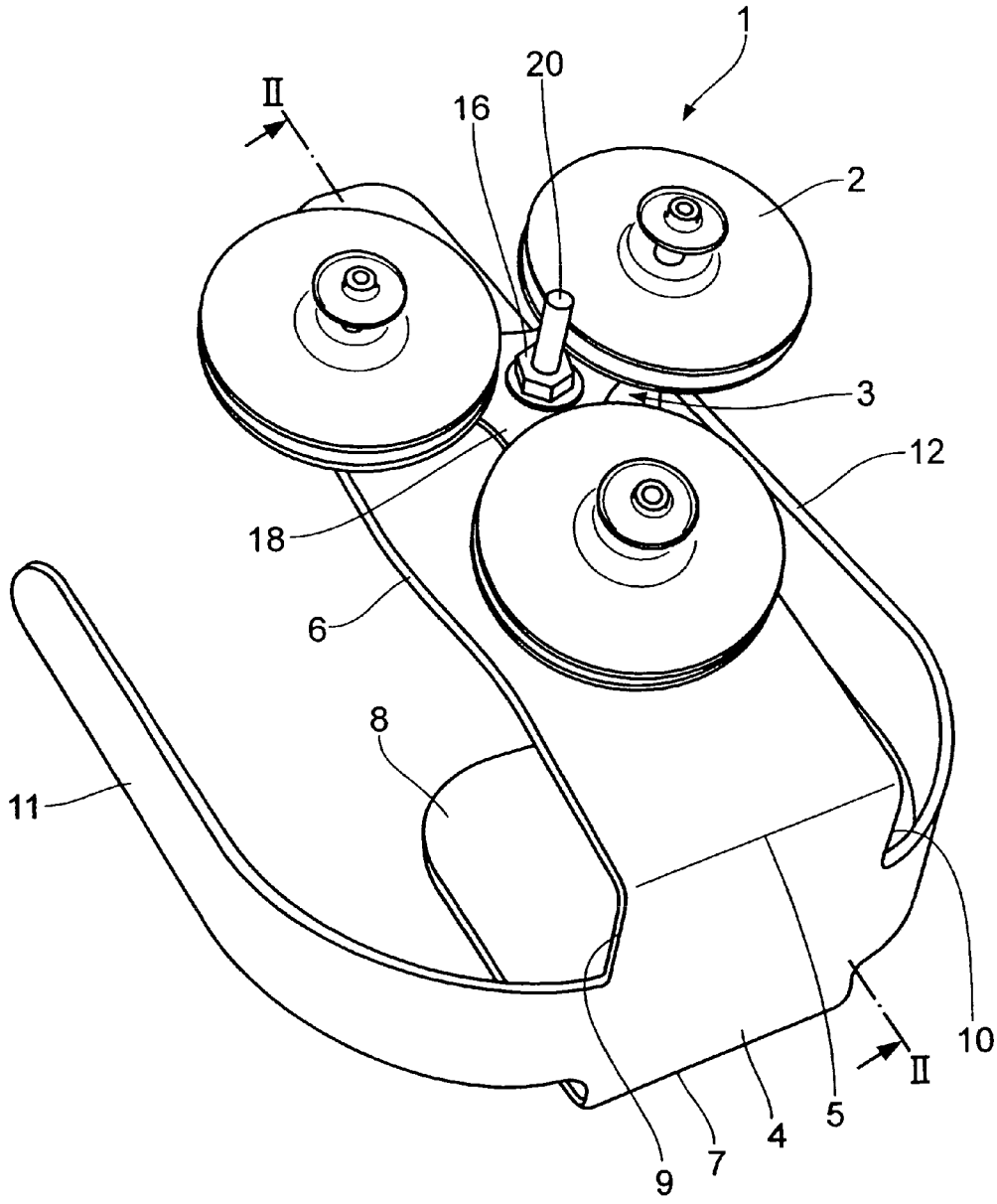
FIG. 1 shows a perspective view of an inventive musical rhythm instrument seen diagonally from the front.
Figure 2:
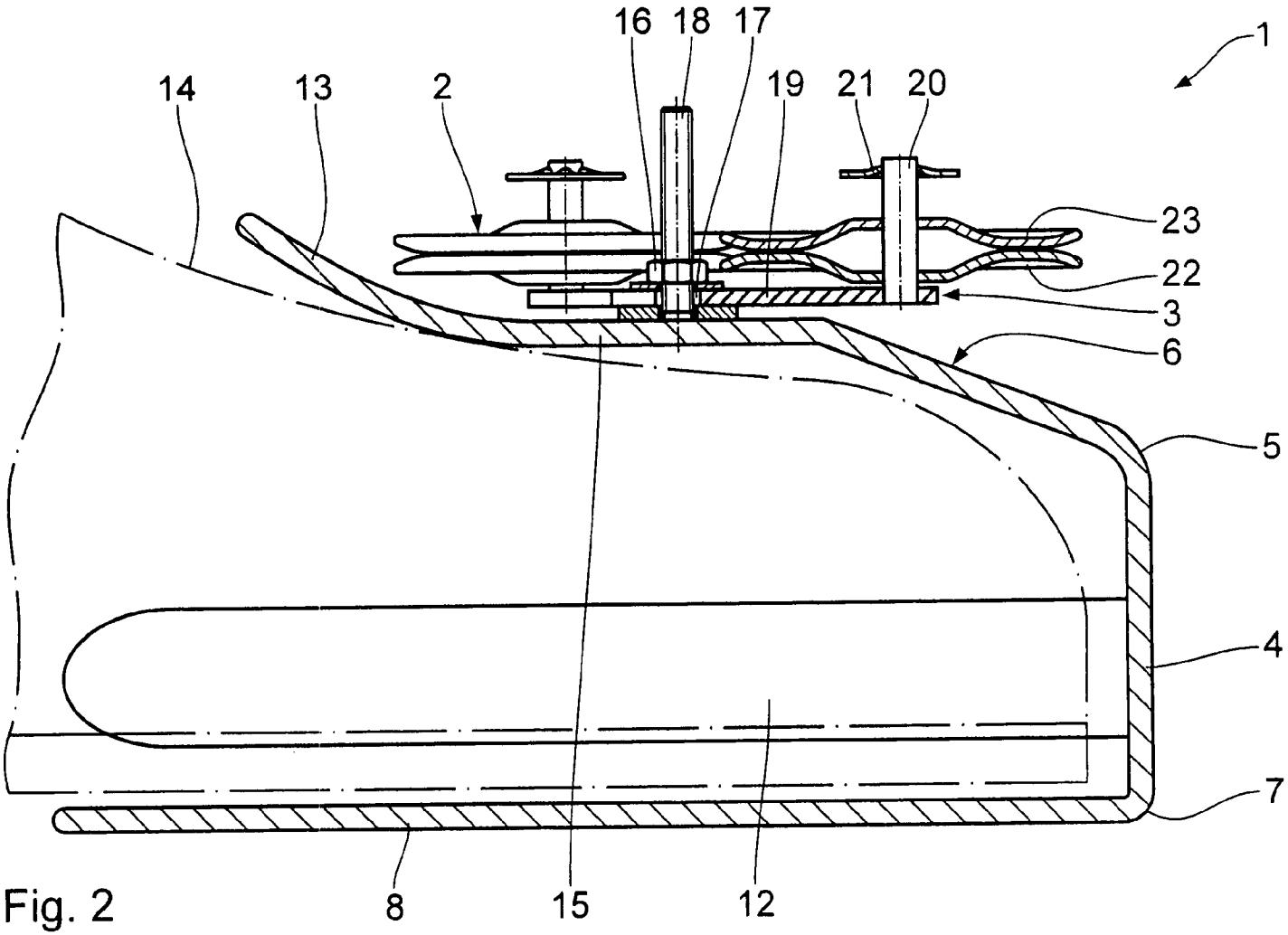
FIG. 2 shows a longitudinal section along the line II-II in FIG. 1.

A musical rhythm instrument 1 shown in the drawing comprises three jingle-like sounding bodies 2 and a holding device 3 for the same.

The holding device 3 has a base plate 4, which is substantially vertical when in use, comprising a first holding projection 6 extending away from the upper edge 5 and a second holding projection 8 extending away from the lower edge 7, with lateral projections 11, 12 extending away from the lateral edges 9, 10.

The projections are dimensioned such that the holding device 3 can be placed in a press fit onto the shoe of a user in such a way that the projections elastically bend open in the process. Fastening means, such as straps or Velcro fasteners may optionally be used in addition.

The upper projection 6 is provided with a bent-up region 13 that facilitates inserting of the user's shoe 14 and adjoining which is a flat support section 15, on which a bolt section 18 is fixed by means of a nut 16 and fastening bore 17, said bolt section 18, in turn, fixing a three-arm holding plate 19. Fastened to each end section of each arm of the holding plate 19 is a bolt 20 having an upper end stop 21. Arranged on each bolt 20 is a lower, upwardly open jingle 22 and an upper, downwardly open jingle 23, which are displaceable in the longitudinal direction of the bolt 20 against the end stop 21 and which generate a tone when the foot is moved or tapped.

What is claimed is:

1. A musical rhythm instrument comprising sounding bodies, and a holding device for the sounding bodies, wherein the holding device (3) is designed to be fastened to a user's foot (14);

wherein the holding device has a resilient upper projection and a resilient lower projection which are spaced apart to resiliently engage the user's foot when inserted into the holding device, and wherein the holding device (3) further has resilient side projections which are also spaced apart to resiliently engage the user's foot when inserted into the holding device.

2. The musical instrument according to claim 1, wherein a top of the holding device (3) has bolt projections (20) extending away from the holding device, on which the sounding bodies (2) are engaged, wherein end stops (21) are provided at a top of the bolt projections (20).

3. The musical instrument according to claim 1, wherein the sounding bodies (2) are fastened to a top of the holding device (3).

4. The musical instrument according to claim 2, wherein the holding device (3) further has resilient side projections which are also spaced apart to resiliently engage the user's foot when inserted into the holding device.

5. The musical instrument according to claim 1, wherein the sounding bodies (2) are arranged on a support plate (18), which in turn, is fixed to the top of the holding device (3), which is screwed thereon.

6. The musical instrument according to claim 4, wherein the sounding bodies are jingles.

7. The musical instrument according to claim 6, wherein the jingles are displaceable on the bolt projections to slide along the axis of the bolt projections.

8. A musical rhythm instrument comprising sounding bodies, and a holding device for the sounding bodies, wherein the holding device (3) is designed to be fastened to a user's foot (14);

wherein the holding device has a resilient upper projection and a resilient lower projection which are spaced apart to resiliently engage the user's foot when inserted into the holding device, and wherein a top of the holding device (3) has bolt projections (20) extending away from the holding device, on which the sounding bodies (2) are engaged, wherein end stops (21) are provided at a top of the bolt projections (20).

9. A musical rhythm instrument comprising sounding bodies, and a holding device for the sounding bodies, wherein the holding device (3) is designed to be fastened to a user's foot (14);

wherein the holding device has a resilient upper projection and a resilient lower projection which are spaced apart to resiliently engage the user's foot when inserted into the holding device, and wherein the sounding bodies (2) are arranged on a support plate (18), which in turn, is fixed to the top of the holding device (3), which is screwed thereon.

10. The musical instrument according to claim 8, wherein the holding device (3) further has resilient side projections which are also spaced apart to resiliently engage the user's foot when inserted into the holding device.

11. The musical instrument according to claim 8, wherein the sounding bodies (2) are fastened to a top of the holding device (3).

12. The musical instrument according to claim 8, wherein the sounding bodies (2) are arranged on a support plate (18), which in turn, is fixed to the top of the holding device (3), which is screwed thereon.

13. The musical instrument according to claim 8, wherein the sounding bodies are jingles.

14. The musical instrument according to claim 13, wherein the jingles are displaceable on the bolt projections to slide along the axis of the bolt projections.

15. The musical instrument according to claim 9, wherein the holding device (3) further has resilient side projections which are also spaced apart to resiliently engage the user's foot when inserted into the holding device.

16. The musical instrument according to claim 9, wherein the sounding bodies (2) are fastened to a top of the holding device (3).

17. The musical instrument according to claim 9, wherein a top of the holding device (3) has bolt projections (20) extending away from the holding device, on which the sounding bodies (2) are engaged, wherein end stops (21) are provided at a top of the bolt projections (20).

18. The musical instrument according to claim 9, wherein the sounding bodies are jingles.

19. The musical instrument according to claim 18, wherein the jingles are displaceable on bolt projections to slide along the axis of the bolt projections.

* * * * *